United States Patent [19]

Schultz

[11] Patent Number: 4,872,469

[45] Date of Patent: Oct. 10, 1989

[54] CRUTCH WITH STAIR DEFLECTOR

[75] Inventor: Jim Schultz, Simi Valley, Calif.

[73] Assignee: Guardian Products, Inc., Calif.

[21] Appl. No.: 800,697

[22] Filed: Nov. 22, 1985

[51] Int. Cl.[4] ..... A61H 3/02

[52] U.S. Cl. ..... 135/69; 135/75; 248/188.5

[58] Field of Search ..... 135/68, 69, 70, 74, 135/75, 76, 77; 248/188.5; 272/70, 70.1–70.4

[56] References Cited

U.S. PATENT DOCUMENTS

| | | | |
|---|---|---|---|
| Re. 32,815 | 1/1989 | Smith | 135/69 |
| 683,568 | 10/1901 | Moore | 135/69 |
| 1,035,760 | 8/1912 | Walton | 135/69 |
| 1,505,081 | 8/1924 | Arndt | 135/69 |
| 4,733,682 | 3/1988 | Ellena | 135/69 |

FOREIGN PATENT DOCUMENTS

| | | | |
|---|---|---|---|
| 72148 | 7/1916 | Austria | 135/69 |
| 115327 | 5/1918 | United Kingdom | 135/69 |
| 124911 | 4/1919 | United Kingdom | 135/69 |
| 1234053 | 6/1971 | United Kingdom | 135/69 |

*Primary Examiner*—Robert A. Hafer
*Assistant Examiner*—Jeffrey L. Thompson
*Attorney, Agent, or Firm*—Vernon D. Beehler; William H. Pavitt, Jr.; Ralf H. Siegemund

[57] ABSTRACT

An improvement to a tubular height adjustable crutch of the type having a foot telescopically slidable within a carrier tube supported between the parallel lower ends of two crutch bows, where the crutch bow ends are right cylinders cut so as to form a right angle corner with the footpiece or carrier tube. A unitary end cap is fitted over the bow ends and the carrier tube for retaining these three members together and to provide an integral bushing for supporting the footpiece against wobbling within the carrier tube. The improvement consists of modifying the cap bottom to provide slanting edges or surfaces for deflecting staircase edges away from possible engagement with the corner defined between the bow ends and the carrier tube, thus preventing consequent injury to the crutch user.

6 Claims, 2 Drawing Sheets

CRUTCH WITH STAIR DEFLECTOR

BACKGROUND OF THE INVENTION

1. FIELD OF THE INVENTION

The present invention pertains generally to the field of walking aids for invalids and is more particularly directed to improved double bow crutch constructions provided with a stair deflector.

2. STATE OF THE PRIOR ART

Double axillary crutches typically comprise two parallel members connected at their upper end by an armrest adapted to fit against a patient's armpit, and bowed inwardly towards each other at their lower ends. An adjustable footpiece is mounted between the two bow members and extends downwardly from the lower curved ends of the bow members to terminate in a tip which makes contact with the ground surface. The footpiece may be a single straight member which is slidable between the two bow members such that it may be fixed at any convenient position, thereby setting a desired overall crutch length. In other crutch designs the foot piece includes two or more telescoping sections, the uppermost of which is fixed between the two bow members while one or more lower sections can be telescoped and fixed at a convenient extension length so as to set the crutch height.

A frequent problem encountered in this type of double bow crutch constructions has been that the lower ends of the bow members terminate in squared-off transverse surfaces adjacent to the footpiece. These transverse surfaces may be quite close to the ground depending on the extension setting of the foot piece and are capable of catching against stair edges when a patient is ascending or descending a staircase. This has led in the past to accidents and injuries.

This applicant is aware of existing crutch configurations which incorporate means for protecting against such accidental engagement of the crutch with the stair edges by providing stair deflector edges or surfaces at the lower ends of the bow members. These are slanting surfaces which cause the crutch to deflect away from and prevent false engagement with stair edges unless the bottom tip of the crutch is firmly set on a horizontal supporting surface. The provision of the slanting stair deflecting edges or surfaces deprive the stair edge from the transverse end surface on which to catch at the lower ends of the two bow members. Such crutch constructions are disclosed by Arndt in U.S. Pat. No. 1,505,081 and to at least some extent by Walton, U.S. Pat. No. 1,035,760.

The Arndt patent is directed to a crutch which has a one piece nontelescoping footpiece. Walton does address the problem of providing stair deflector means in a crutch with a telescoping foot piece, which however does not provide a completely satisfactory solution. The Walton footpiece is illustrated as comprising three telescoping segments. The uppermost segment is fixed in position between the two bow members while the intermediate segment can be telescoped into the upper fixed segment. The lower ends of the bow members are fitted with a cap which provides tapering lateral edges or surfaces which are capable of deflecting staircase edges. However, the sole means of interlocking the fixed and intermediate footpiece segments so as to lock the footpiece is a single screw threaded through the end cap. Provision of a single point of support of the telescoping intermediate footpiece segment is inadequate to prevent wobble of the intermediate segment within the upper fixed segment of the footpiece since a certain amount of clearance is required between the two segments to allow easy sliding.

SUMMARY OF THE INVENTION

The present invention overcomes these and other shortcomings of the prior art by providing an end cap for a dual bow crutch. The end cap has three sockets defined in its upper side for receiving and interconnecting the lower ends of the fixed footpiece mounting tube and the lower ends of the two bow members. The center socket has an open bottom and defines a bushing at the open lower end of the fixed footpiece mounting tube. The bushing closely fits the cross section of the footpiece and cooperates with a footpiece locking pin or fastener to support the footpiece at two axially spaced apart points to thereby prevent wobbling of the footpiece within its fixed mounting tube. The locking pin fastener interlocks the slidable footpiece with its mounting tube at a point upwardly removed from the bushing so as to more stably support the telescoping footpiece segment. The end cap further defines stair deflecting lower edges which taper from the bow members to the footpiece so as to avoid presenting transverse end surfaces to the edges of a staircase.

The novel end cap of this invention therefore integrates a footpiece bushing which in some existing crutches was provided as a fitting separate from retaining piece binding together the lower ends of the bow members and the footpiece mounting tube into a single end cap which serves the function of previously separate pieces, while providing the additional stair deflecting function, all in a simple economical and easy to assemble structure.

In an alternate aspect of the invention, a stair deflecting end cap is fitted to a wooden crutch having a one piece adjustable footpiece. A still further aspect of the invention, improves on a wooden crutch of the type in which a retaining band encircles and holds together the lower ends of the two bow members and the footpiece between the two bow members, the entire assembly being held together by a retaining bolt which extends through the band as well as the footpiece and bow members. The crutch is improved by shaping the lower ends of the bow members to form curving stair deflecting surfaces, all as illustrated in the accompanying drawings and more fully explained in the following detailed description of the preferred embodiments.

DETAILED DESCRIPTION OF THE PREFERRED EMBODIMENTS

Figure 1:
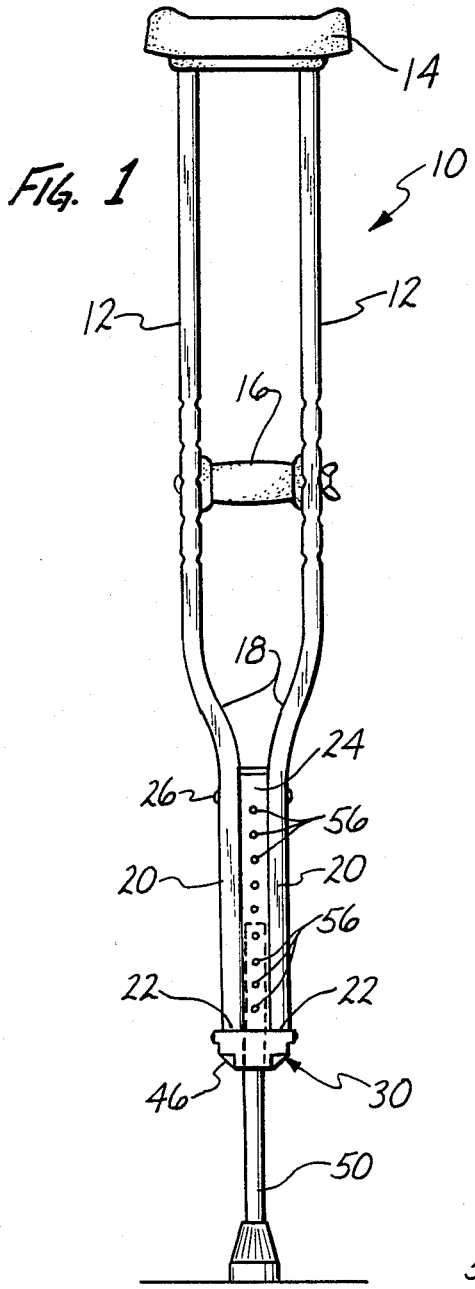
FIG. 1 is a side elevational view of a double bow axillary crutch fitted with a stair deflecting end cap according to the present invention.
Figure 2:
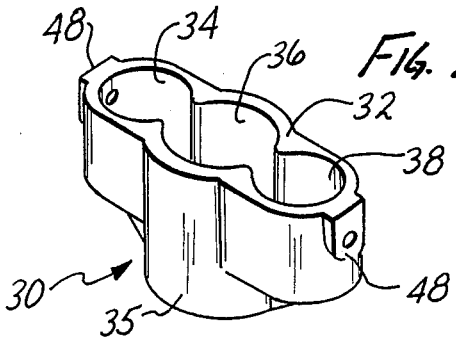
FIG. 2 is a top side perspective view of the end cap fitted to the crutch of FIG. 1.

With reference to the drawings, FIG. 1 shows a double bow axillary crutch 10 which includes two tubular bow members 12 having parallel upper portions joined by an arm pad 14 and further connected at an intermediate point by a handle 16. The bow members have curved bow sections 18 and parallel lower portions 20 terminating in lower ends 22. A footpiece mounting tube 24 is fixed between the parallel sections 20 of the bow members by means of a rivet 26 traversing the footpiece mounting tube and the two bow tubes 12 at an upper point, and by an end cap 30 which receives and interconects the lower ends 22 of the bow members and the lower end 28 of the foot piece mounting tube 24, all as best understood by reference to FIG. 4*b*.

Figure 4A:
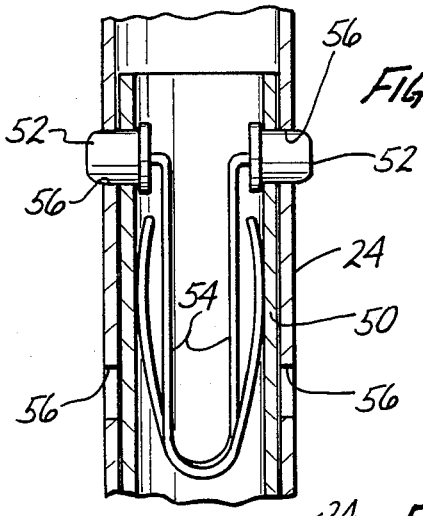
FIG. 4*a* illustrates in elevational cross sectional view of the locking pin mechanism for fixing the position of the telescoping footpiece.
Figure 4B:
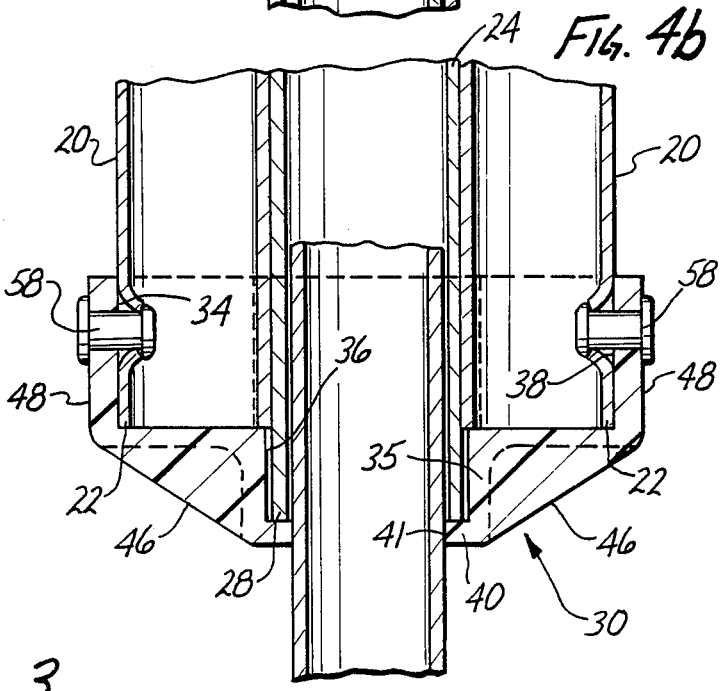
FIG. 4*b* illustrates in elevational cross section, the stair deflecting end cap and the footpiece bushing incorporated into the end cap.
Figure 3:
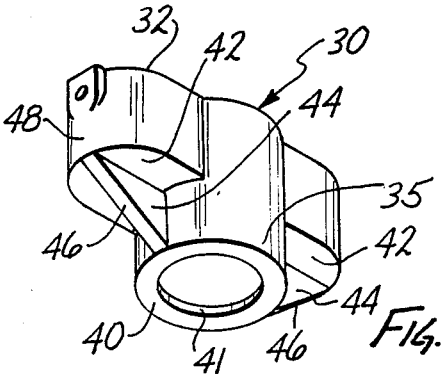
FIG. 3 is a side bottom perspective view of the end cap of FIG. 2.

The end cap 30 has an upper side 32 in which are defined three substantially cylindrical sockets 34, 36, 38 with their axes mutually parallel and also parallel to the foot piece and bow members of the crutch. The central axes of the three sockets lie within a common plane such that the socket 36 is a center socket disposed between side sockets 34 and 38. The cylindrical wall 35 of the center socket 36 extends downwardly below the bottoms 42 of the side sockets as best seen in FIG. 3 and 4b and terminates in a circular bushing 40 which defines a footpiece opening 41 having a diameter somewhat smaller than the inner diameter of the center socket 36. The bottoms 42 of side sockets 34 and 38 are preferably closed. The end cap 30 further includes triangular webs 44 extending between each socket bottom 42 and the center socket wall 35 which define slanting or tapering side edges 46 rising from the bottom center of the cap 30, i.e. from the level of bushing 40 upwardly towards the sides 48 of the end cap at the laterally outermost point of each socket bottom 42. The edges 46 prevent stair edges from catching underneath the squared off transverse lower ends 22 of the bow members.

A footpiece segment 50 telescopically slides into the foot piece mounting tube 24 and is provided with a locking pin mechanism which includes a pair of spring loaded pins 52 projecting outwardly at diametrically opposed holes in the footpiece tube wall and spring loaded by springs 54. The two pins 52 can be manually pushed into the foot piece 50 against springs 54 so as to release and allow sliding movement of the footpiece within the mounting tube 24. The footpiece mounting tube 24 is provided with a number of pin holes 56 spaced along the length of tube 24. The footpiece locking pins 52 may be released under spring urging into any of the holes 56 so as to interlock the footpiece 50 to the mounting tube 24 at any desired relative extension of the footpiece thereby fixing a desired crutch height. The diametrically opposing pins 52 interlock the telescoping tubes 50 and 24 and thereby hold the upper end of the footpiece against wobbling within its mounting tube, particularly in a plane transverse to the orientation of the two pins if the pins fit closely into the openings 56.

The lower end of the footpiece 50 is supported against wobbling within its mounting tube 24 by the bushing 40 provided in the center socket 36 of the stair deflecting end cap 30, as illustrated in FIG. 4*b*. It must be understood that FIG. 4*a* is rotated 90 degrees about a vertical axis relative to FIG. 4*b* so as to better illustrate the interlocking pins 52 which would be seen end-on without the aforementioned rotation, as will become apparent by inspection of FIG. 1. The end cap 30 is secured to the lower ends of the bow members by means of two rivets 58 passing through side walls 48 of the end cap and engaging the tube walls of the bow members 20 near their lower ends as best seen in FIG. 4*b*. The end cap 30 may be molded in a plastic material as a single piece.

Figure 5:
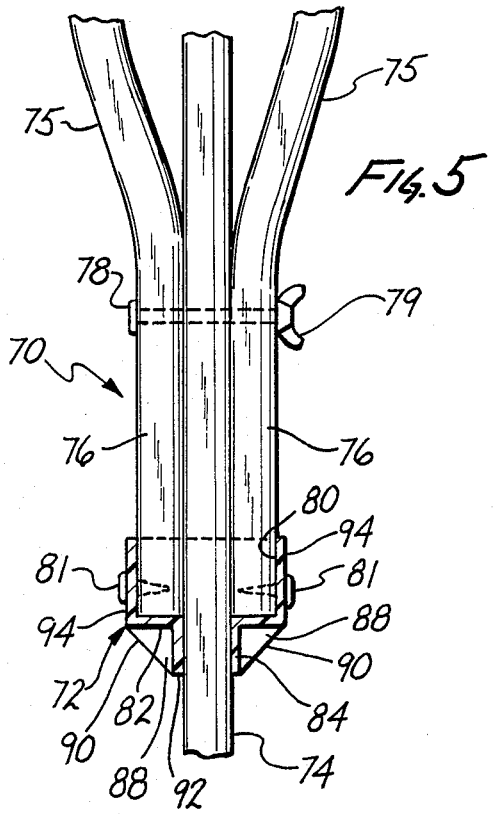
FIG. 5 is a fragmentary side elevational view of a wooden crutch provided with a stair deflecting cap according to this invention.

Turning now to FIG. 5, a double bow crutch 70 is shown in relevant part to illustrate the provision of a stair deflecting end cap 72 in a wooden crutch having a one piece footpiece 74 slidable between the adjacent parallel lower ends 76 of the two bow members 75. The footpiece 74 is perforated with bolt holes (not shown) at a number of locations spaced along the footpiece 74. A retaining bolt 78 extends through the bow member portions 76 and through a selected bolt hole in the footpiece 74, so as to lock together the foot piece and bow members. The crutch is adjustable by removing the bolt 78 and sliding the footpiece 74 through the end cap 72 to a desired position, and then reinserting the bolt 78 through aligned holes in the footpiece and the bow member portions 76 to thereby fix the footpiece in place. The bolt 78 is retained by a winged nut 79. The end cap 72 is secured to the bow members 78 by means of two screws 81 threaded through holes 86 in the cap and into the bow members 76.

Figure 6:
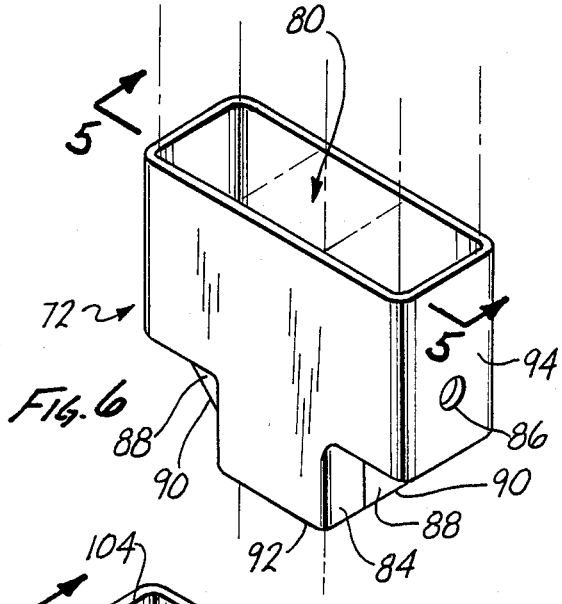
FIG. 6 is a top side perspective view of a first embodiment of the end cap for the wooden crutch of FIG. 5.

The stair deflecting end cap 72 is better seen in perspective view in FIG. 6. The cap 72 comprises a cap wall defining a rectangular receptacle 80, a cap bottom 82, a central rectangular opening in the bottom communicating into a tubular guide extension 84 of rectangular cross section. The interior dimensions of the receptacle 80 are just slightly greater than the combined width of the two bow members 76 and footpiece 74, while the footpiece guide 84 is dimensioned to fit closely about the cross section of the footpiece 74 and allow sliding movement of the footpiece through the cap 72. Two opposed screw openings 86 are formed in the side walls 94 of the end cap 72 for allowing insertion of the retainer screws 81 through the cap and into threading engagement with the bow members, thus securing the cap to the bow members 76. Two co-planar triangular webs 88 extend between the bottom 82 of the cap and each side of the lower footpiece extension 84 of the cap. The webs 88 define stair deflecting edges 90 which provide a tapering, gradual transition between the sides 94 of the end cap and the lower edge 92 of the footpiece extension. The slanting edges 90 prevent staircase edges from being caught in the two corners defined between the horizontal bottom wall 82 and the vertical extension wall 84 of the cap 72.

Figure 7:
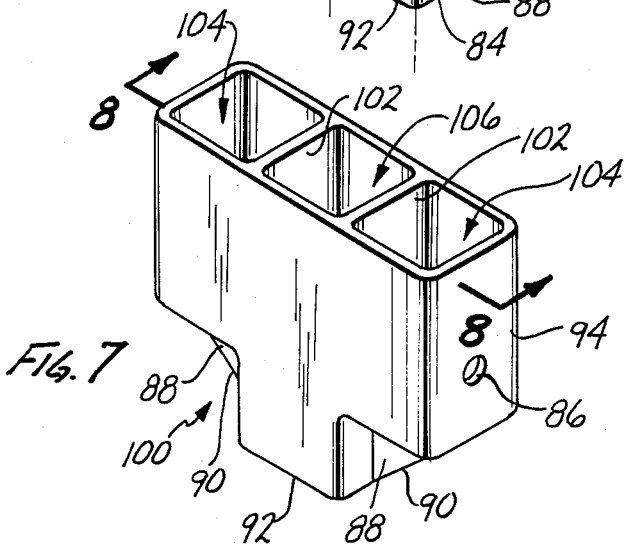
FIG. 7 is a top side perspective view of an alternate embodiment of the stair deflecting end cap for a wooden crutch.
Figure 8:
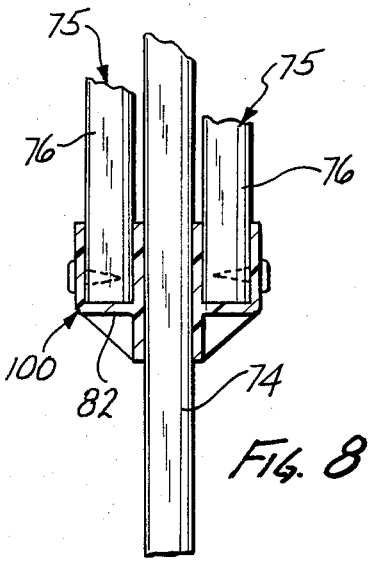
FIG. 8 is a partial side elevational view partly in section of a wooden crutch fitted with the stair deflecting end cap of FIG. 7.

FIGS. 7 and 8 illustrate an alternate end cap 100 which is similar to that of FIG. 6 as indicated by common numbering of common elements, but is modified by provision of partitions 102 which divide the single receptacle 80 of the fig. 6 end cap into two side sockets 104, each of which receives the lower end of a bow member 75 of the crutch, and a central tubular footpiece passage 106 of rectangular cross section through which slides the footpiece 74 for adjusting the crutch height.

Figure 9:
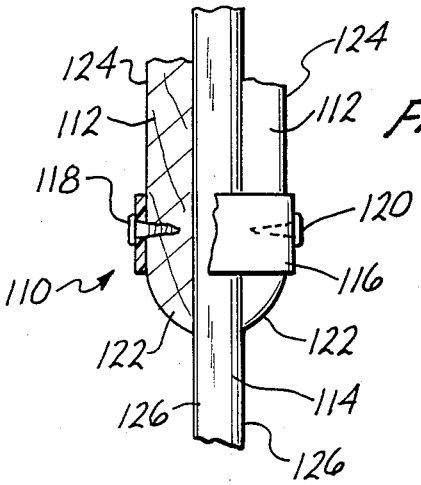
FIG. 9 is a side elevational view partly in section of a wooden crutch wherein the bow members are shaped to form stair deflecting surfaces without need for a stair deflecting end cap.
Figure 10:
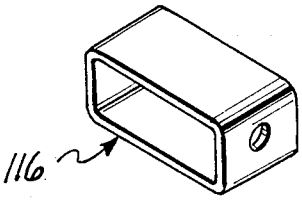
FIG. 10 is a perspective view of the retaining band used in the crutch of FIG. 9.

FIG. 9 illustrates an alternate manner of providing stair deflecting surfaces on a wooden crutch which is only shown in relevant part and comprises bow members 112 between which is slidable a footpiece 114. Both the bow member and the foot piece are of rectangular cross section. A retaining band 116 encompasses the bow members and footpiece to retain these three pieces in parallel adjacent relationship, while allowing the footpiece 114 to slide freely intermediate the bow members 112. The foot piece 114 is provided with conventional spaced bolt hole openings (not shown) in a manner similar to that of the crutch of FIG. 5, and is provided with two retaining screws 118 which extend through the retaining band 116 and are threaded into the bow members 112. The footpiece 114 is adjustably interlocked to the bow members against relative sliding movement by a transverse retaining bolt not shown in FIG. 9 but similar to bolt 78 and nut 79 of FIG. 5. The lower ends of the bow members 112 are arcuately curved to provide stair deflecting surfaces 122 which taper from the sides 124 of the two bow members towards the sides 126 of the foot piece 114. The stair deflecting surfaces 122 thus provide a gradual flaring of the crutch profile from the relatively narrow footpiece to the wider bow members, thus preventing staircase edges from wedging into any corners which would otherwise be defined by a stepped, abrupt transition between squared off lower ends of the bow members and the footpiece 114. The curved shaping of the bow member ends 122 serves a purpose similar to the slanting edges 90 of the end caps of FIG. 5–8 but in a more economical manner which may be desirable in lower cost wooden crutches of basic construction.

While particular embodiments of the invention have been described and illustrated for purposes of clarity, still further changes, alterations and substitutions will become apparent to those possessed of average skill in the art. Therefore, the scope of the invention is to be limited only by the following claims.

I claim:

1. In a crutch of the type including two bow members having upper ends attached to an arm support and parallel lower ends, a footpiece mounting tube affixed lower end, a footpiece telescopically slidable within said mounting tube for adjusting the overall length of the crutch, and a manually releasable fastener means for locking the footpiece to said mounting tube at a first location upwardly removed from said open lower end against said sliding movement, the improvement comprising:

a unitary end cap having three sockets defined in its upper side for receiving and interconnecting the lower ends of said mounting tube and said bow members, the lower end of one of said sockets defining a bushing at the lower end of said mounting tube, said bushing closely fitting the cross-section of said footpiece and cooperating with said fastener means to support the footpiece at a second location axially spaced from said first location thereby to prevent wobbling of the footpiece within said mounting tube, the bottom of said end cap defining stair deflecting lower edges comprising surfaces tapering inwardly from the lower ends of the bow members to said bushing.

2. The improvement of claim 1 wherein said three sockets are each substantially cylindrical and are disposed with mutually parallel center axes.

3. The improvement of claim 2 wherein the center axes of said three sockets lie in a common plane such that there is a centre socket for receiving the end of said mounting tube and two side sockets for receiving the lower ends of the bow members.

4. The improvement of claim 3 wherein said two side sockets have closed bottoms and said center socket has an open bottom defining said footpiece bushing.

5. The improvement of claim 4 wherein said end cap includes a center portion defining said center socket and lateral portions, said center portion extending axially below said closed bottoms, said stair deflecting edges being defined by web portions extending between each of said closed bottoms and said center portion.

6. In a crutch of the type including two cylindrical tubular bow members having upper ends attached to an arm support and having parallel lower ends terminating in round cylindrical lower ends, a cylindrical footpiece mounting tube affixed between said bow members and terminating in an open lower end, said bow elements having lower ends cut transversely to said mounting tube, a footpiece telescopically slideable within said mounting tube for adjusting the overall length of the crutch, and a manually releasable fastener for locking the footpiece to said mounting tube at a first location upwardly removed from said open lower end against said sliding movement, the improvement comprising:

a unitary end cap having an upper side and a bottom side and three axially parallel cylindrical sockets including a central socket and two lateral sockets adjacent thereto, said sockets being open on said upper side for receiving said bow members and said mounting tube, said center socket being axially extended on said bottom side of said cap lower than said lateral sockets, the bottom end of said center socket being open and defining a bushing of diminished aperture relative to its upper end aperture for closely slidably admitting said footpiece therethrough and cooperating with said fastener means by supporting the footpiece at a second location axially spaced from said first location thereby to prevent wobbling of the footpiece within said mounting tube;

said lateral sockets having closed bottoms transverse to said mounting tube, and a web element between said extended end of the center socket and the bottom of each said lateral socket defining stair deflecting lower edges slanting upwardly from said bushing and diametrically to each lateral socket thereby to prevent stair case edges from being caught in the corner defined between the lateral socket bottom and said extended center socket.

* * * * *